US010655266B2

(12) United States Patent
Rajendran et al.

(10) Patent No.: US 10,655,266 B2
(45) Date of Patent: May 19, 2020

(54) LINT PROCESSING FLUID PUMP FOR A LAUNDRY APPLIANCE

(71) Applicant: WHIRLPOOL CORPORATION, Benton Harbor, MI (US)

(72) Inventors: Arun Rajendran, St. Joseph, MI (US); Michael Jon Vriezema, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 208 days.

(21) Appl. No.: 15/364,987

(22) Filed: Nov. 30, 2016

(65) Prior Publication Data

US 2018/0148883 A1 May 31, 2018

(51) Int. Cl.

| | |
|---|---|
| ***D06F 39/10*** | (2006.01) |
| ***D06F 37/14*** | (2006.01) |
| *A47L 15/42* | (2006.01) |
| *D06F 39/08* | (2006.01) |

(52) U.S. Cl.

CPC ..... *D06F 39/10* (2013.01); *D06F 37/145* (2013.01); *A47L 15/4208* (2013.01); *A47L 15/4227* (2013.01); *D06F 39/085* (2013.01)

(58) Field of Classification Search

CPC ..... D06F 39/10; D06F 37/145; D06F 39/085; A47L 15/4225; A47L 15/4208; A47L 15/4206; A47L 15/4202; A47L 15/4227

See application file for complete search history.

(56) References Cited

U.S. PATENT DOCUMENTS

| | | | | |
|---|---|---|---|---|
| 2,934,023 | A | 4/1960 | Lamkin et al. | |
| 3,129,711 | A | 4/1964 | Schmitt-Matzen | |
| 3,217,884 | A * | 11/1965 | Long | B01D 29/115 210/108 |
| 3,359,907 | A | 12/1967 | Bochan | |
| 3,455,119 | A | 7/1969 | Bright | |
| 3,653,807 | A | 4/1972 | Platt | |
| 3,680,893 | A | 8/1972 | Giraud | |
| 3,751,179 | A | 8/1973 | Wassmann | |
| 3,773,432 | A | 11/1973 | Chow et al. | |
| 3,836,001 | A | 9/1974 | Heldreth | |
| 3,896,641 | A | 7/1975 | Worst | |
| 3,953,146 | A | 4/1976 | Sowards | |
| 3,975,931 | A | 8/1976 | Bischkopf | |
| 4,068,870 | A | 1/1978 | Whitney et al. | |

(Continued)

FOREIGN PATENT DOCUMENTS

| | | |
|---|---|---|
| CH | 707892 | 10/2014 |
| CN | 202630562 | 12/2012 |

(Continued)

*Primary Examiner* — Joseph L. Perrin
*Assistant Examiner* — Irina Graf
(74) *Attorney, Agent, or Firm* — Price Heneveld LLP

(57) ABSTRACT

A lint removal system for a laundry appliance includes a lint washing assembly adapted to deliver wet lint to a disposal area. An impeller is disposed within a continuous processing chamber of a pump casing, the impeller operable to deliver a fluid from the disposal area to a drain outlet. A blade assembly is disposed within the continuous processing chamber, the blade assembly rotationally operable to process the wet lint from the disposal area to define lint particles that are delivered with the fluid to the drain outlet.

19 Claims, 12 Drawing Sheets

(56) References Cited

U.S. PATENT DOCUMENTS 4,251,758 A 2/1981 Pedersen et al.
4,409,532 A 10/1983 Hollenbeck et al.
4,451,069 A 5/1984 Melone
4,600,361 A 7/1986 Bianco
4,647,082 A 3/1987 Fournier et al.
4,671,540 A 6/1987 Medvick et al.
4,804,213 A 2/1989 Guest
5,142,214 A 8/1992 Purson et al.
5,214,936 A 6/1993 Lim et al.
5,285,664 A 2/1994 Chang et al.
5,395,140 A 3/1995 Wiethorn
5,493,745 A * 2/1996 Hauch ..... D06F 39/083 68/18 D
5,628,531 A 5/1997 Rosenberg et al.
5,658,020 A 8/1997 Carman et al.
5,740,835 A 4/1998 Murphy
5,911,750 A 6/1999 Mandel et al.
5,921,104 A 7/1999 Chang
6,070,419 A 6/2000 Chang
6,114,827 A 9/2000 Alvaro
6,159,962 A 12/2000 Steiner et al.
6,402,962 B1 * 6/2002 Bruntz ..... B01D 29/66 210/108
6,519,962 B1 2/2003 Schuetter
6,574,979 B2 6/2003 Faqih
6,574,984 B1 6/2003 McCrea et al.
6,672,628 B2 1/2004 Thomas et al.
6,854,772 B2 2/2005 Weller et al.
6,863,314 B2 3/2005 Guest
6,913,294 B2 7/2005 Treverton et al.
7,316,428 B2 1/2008 Takayanagi et al.
7,458,171 B1 12/2008 Lentz
7,510,216 B2 3/2009 Tomerlin et al.
7,624,896 B2 12/2009 Doglioni Majer
7,707,860 B2 5/2010 Hong et al.
7,770,418 B2 8/2010 Kramme et al.
7,866,182 B2 1/2011 Lim et al.
8,029,024 B2 10/2011 Guest
8,083,104 B2 12/2011 Roetker et al.
8,171,757 B2 5/2012 Dahlke
8,266,814 B2 9/2012 Grunert
8,499,978 B2 8/2013 Dalchau et al.
8,540,118 B2 9/2013 McDonald et al.
8,656,731 B2 2/2014 Kim
8,695,371 B2 4/2014 Boarman et al.
8,789,854 B2 7/2014 Christian, Jr. et al.
8,926,275 B2 1/2015 Badafem et al.
8,991,220 B2 3/2015 Buso et al.
9,010,144 B2 4/2015 Park et al.
9,065,363 B2 6/2015 Marioni
9,088,236 B2 7/2015 Marioni
9,255,358 B2 2/2016 Kim
9,273,903 B2 3/2016 Vian et al.
9,309,103 B2 4/2016 Ergican et al.
9,373,210 B2 6/2016 Wittern, Jr. et al.
9,404,211 B2 8/2016 Hill et al.
9,506,682 B2 11/2016 Yun et al.
9,581,377 B2 2/2017 Kim et al.
9,617,680 B2 4/2017 Kitayama et al.
9,644,308 B2 5/2017 Leibman et al.
9,702,078 B2 7/2017 Lee
9,702,080 B2 7/2017 Lee et al.
9,809,922 B2 11/2017 Salomonsson
9,890,029 B2 2/2018 Comsa et al.
9,903,064 B2 2/2018 Del Pos et al.
9,915,468 B2 3/2018 You et al.
2006/0277690 A1 12/2006 Pyo et al.
2008/0276657 A1 * 11/2008 Kim ..... A47L 15/4206 68/12.13
2010/0253075 A1 10/2010 Werth
2011/0126865 A1 * 6/2011 Yoon ..... A47L 15/4208 134/104.1
2012/0032629 A1 2/2012 Peterson et al.
2012/0104021 A1 5/2012 Cur et al.
2012/0114473 A1 5/2012 Badafem et al.
2012/0118023 A1 * 5/2012 Guerrero Lara ..... D06F 13/06 68/12.19
2012/0228871 A1 9/2012 Li
2012/0246960 A1 10/2012 Lee et al.
2012/0291822 A1 * 11/2012 Tuller ..... A47L 15/4208 134/110
2012/0318309 A1 * 12/2012 Tuller ..... A47L 15/4206 134/56 D
2013/0257043 A1 10/2013 Guest
2013/0318813 A1 12/2013 Hong et al.
2014/0013616 A1 1/2014 Lee et al.
2014/0283542 A1 9/2014 Jang
2015/0197417 A1 7/2015 Stagg et al.
2015/0225226 A1 8/2015 You et al.
2015/0345072 A1 12/2015 Ko et al.
2016/0010271 A1 1/2016 Shin et al.
2016/0083238 A1 3/2016 Koo
2016/0083894 A1 3/2016 Bison et al.
2016/0090681 A1 3/2016 Nash et al.
2016/0115643 A1 4/2016 Bison et al.
2016/0138209 A1 5/2016 Kitayama et al.
2016/0138849 A1 5/2016 Lee et al.
2016/0201985 A1 7/2016 Lee et al.
2016/0205988 A1 7/2016 Bird et al.
2016/0206173 A1 * 7/2016 Durham ..... A47L 15/4202
2016/0341462 A1 11/2016 Kim
2017/0037560 A1 2/2017 Shin et al.
2017/0051449 A1 2/2017 Nam et al.
2017/0059224 A1 3/2017 Bae et al.
2017/0298563 A1 10/2017 Roetker et al.
2017/0341920 A1 11/2017 Gonzales

FOREIGN PATENT DOCUMENTS

DE 2005011732 7/2006
EP 0454640 10/1991
EP 0682404 11/1995
EP 945973 9/1999
EP 2329757 6/2011
EP 2508668 A1 10/2012
EP 2620541 7/2013
GB 2288457 A 10/1995
JP S57155777 9/1982
JP 2006177330 7/2006
JP 2008259665 10/2008
JP 2009287527 12/2009
KR 1020110125570 11/2011
KR 101588137 1/2016
WO 0346451 6/2003
WO 2004045351 6/2004
WO 20120226555 2/2012
WO 2012072477 6/2012
WO 2012146534 A2 11/2012
WO 2014115976 7/2014
WO 2015010731 1/2015
WO 2016204414 12/2016
WO 2017023122 2/2017

* cited by examiner

LINT PROCESSING FLUID PUMP FOR A LAUNDRY APPLIANCE

FIELD OF THE DEVICE

The device is in the field of laundry appliances, and more specifically, a fluid pump that includes lint processing capabilities for removing lint from the laundry appliance.

SUMMARY

In at least one aspect, a lint removal system for a laundry appliance includes a lint washing assembly adapted to deliver wet lint to a disposal area. A semi-open impeller is disposed within a continuous processing chamber of a pump casing. The semi-open impeller is operable to deliver a fluid from the disposal area to a drain outlet. A blade assembly is disposed within the continuous processing chamber, where the blade assembly is rotationally operable to process the wet lint from the disposal area to define lint particles that are delivered with the fluid to the drain outlet.

In at least another aspect, a lint processing pump includes a pump casing having an interior cavity. An impeller is disposed within the interior cavity. A blade assembly is disposed within the interior cavity, adjacent the impeller. The blade assembly includes a rotationally operable blade and a filter engaged with the blade. Operation of the blade defines a lint processing state of the blade assembly wherein the blade slidably engages a cutting surface of the filter and places the blade in fluid communication with the impeller.

In at least another aspect, a lint processing pump includes a pump casing having a continuous interior cavity. An impeller is disposed within the continuous interior cavity proximate a pump outlet. A blade assembly is disposed with in the continuous interior cavity proximate a fluid/lint inlet. Operation of the blade assembly defines a lint processing state and places the fluid/lint inlet in communication with the pump outlet via the continuous interior cavity.

In at least another aspect, a method for removing lint from a laundry appliance includes delivering wet lint from a lint washing area to a lint disposal area. The method also includes activating a lint processing pump having a blade assembly and a semi-open impeller that are disposed within a single continuous processing chamber. The method also includes delivering wet lint from the lint disposal area to the blade assembly via a fluid/lint inlet. The method also includes processing the wet lint within the blade assembly to define lint particles. The method also includes delivering the lint particles through a filter of the blade assembly to the semi-open impeller. The method also includes rotating the impeller to move the lint particles to a drain outlet.

These and other features, advantages, and objects of the present device will be further understood and appreciated by those skilled in the art upon studying the following specification, claims, and appended drawings.

DETAILED DESCRIPTION OF EMBODIMENTS

Figure 1:
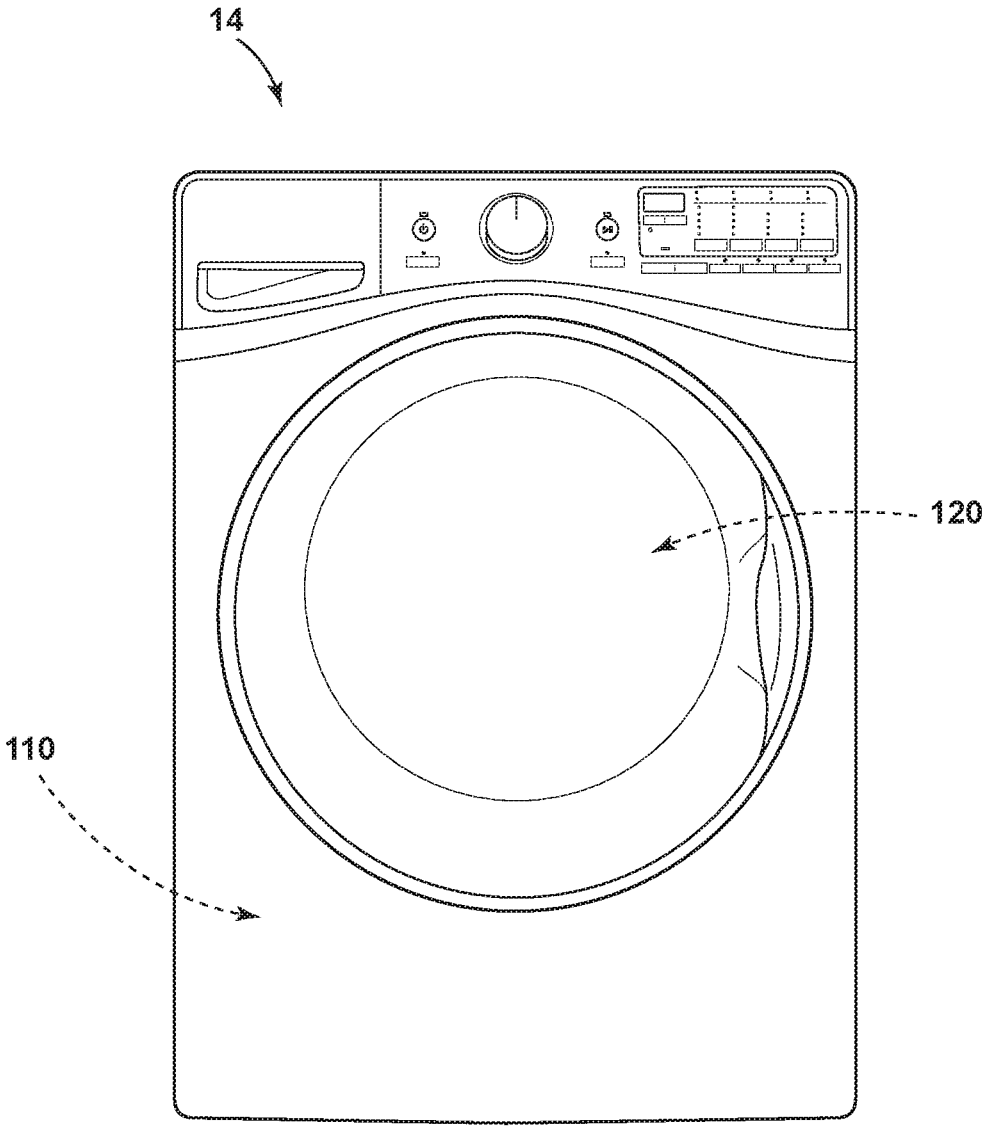
FIG. 1 is a front elevational view of a laundry appliance incorporating a lint removal system having an aspect of the lint processing pump.
Figure 2:
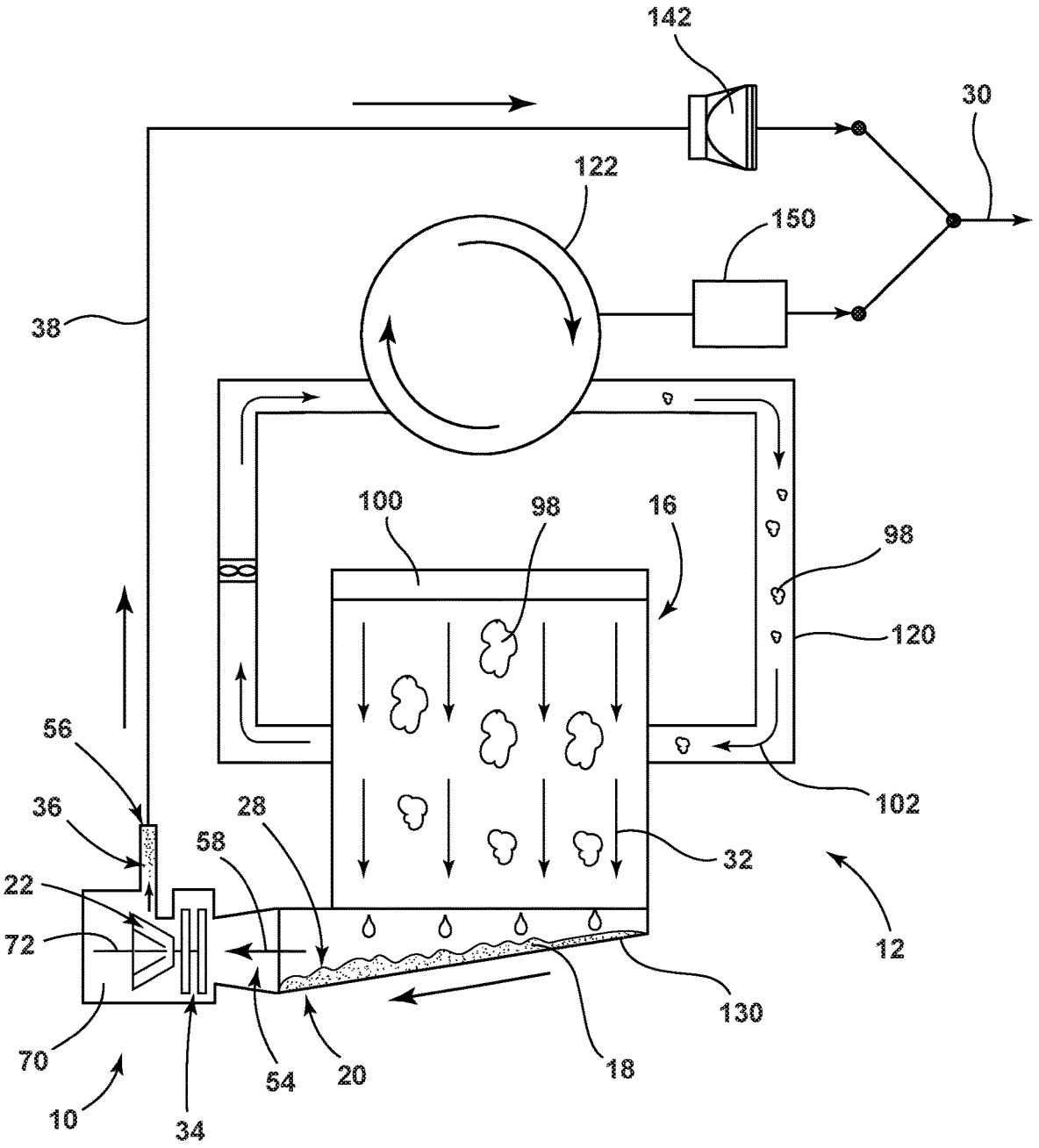
FIG. 2 is a schematic diagram illustrating an aspect of a lint removal system and lint processing pump of a laundry appliance.
Figure 3:
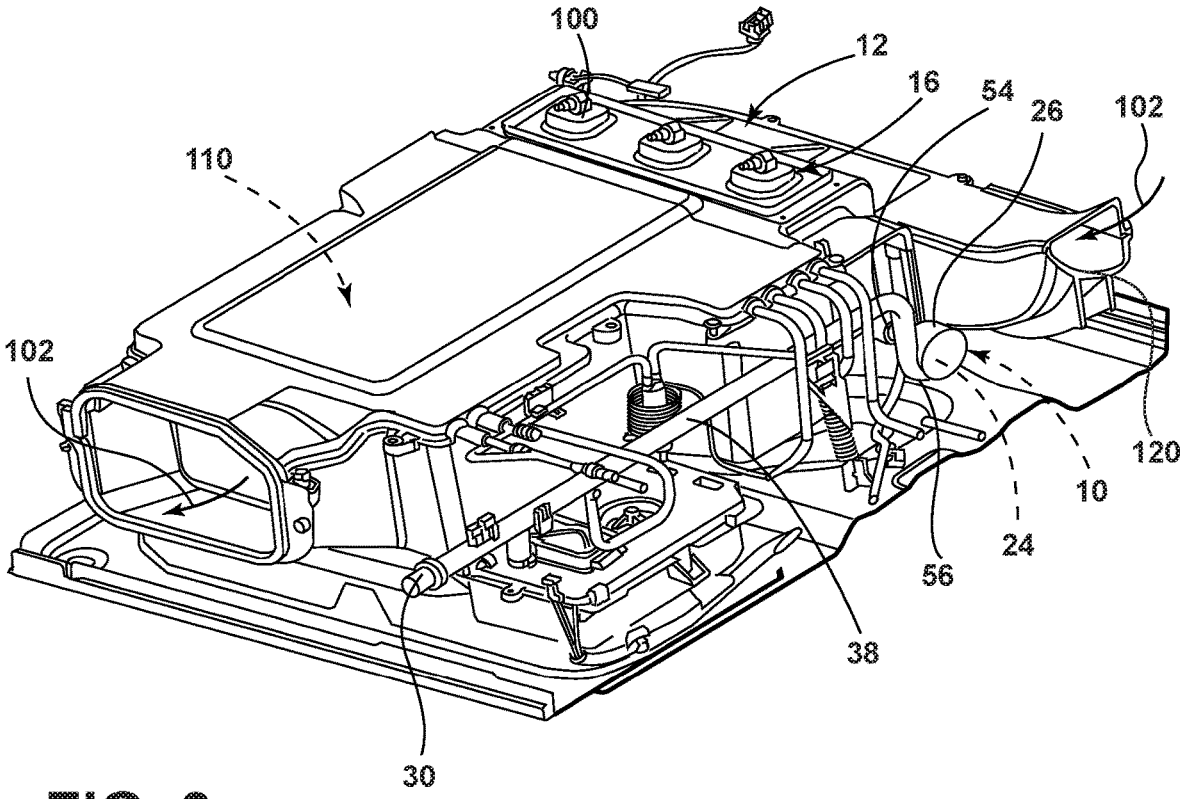
FIG. 3 is a top perspective view of a lint removal system for a laundry appliance.
Figure 4:
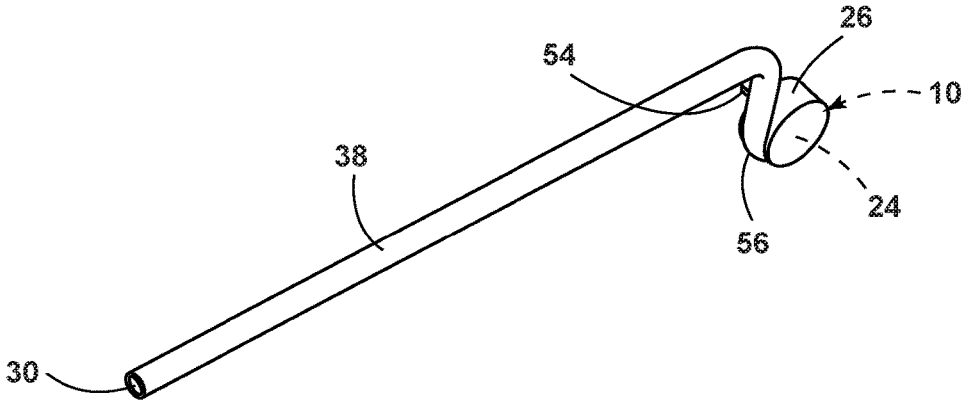
FIG. 4 is a top perspective view of an aspect of the pump casing and drain outlet for the lint processing pump.
Figure 5:
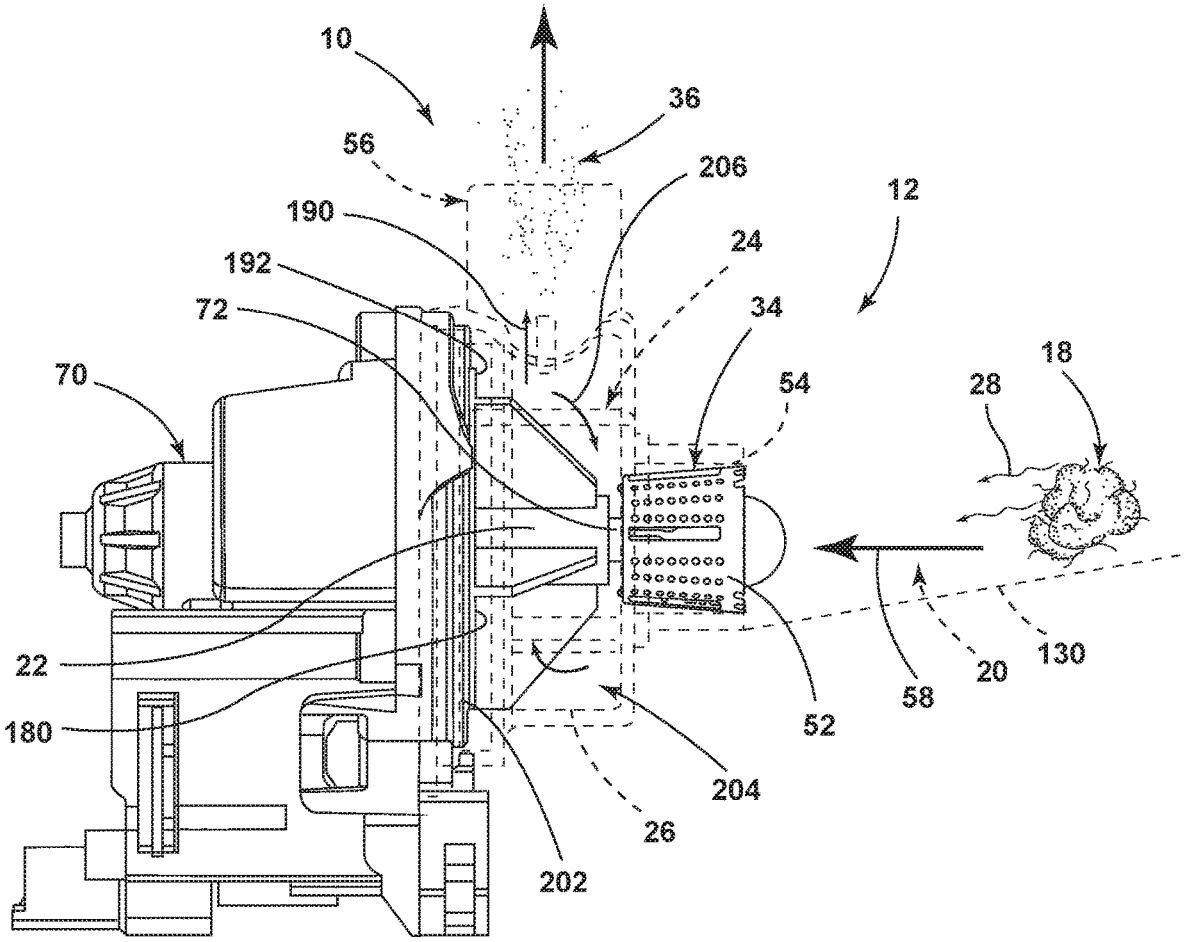
FIG. 5 is a side elevational view of an aspect of a lint processing pump for a lint removal system.
Figure 6:
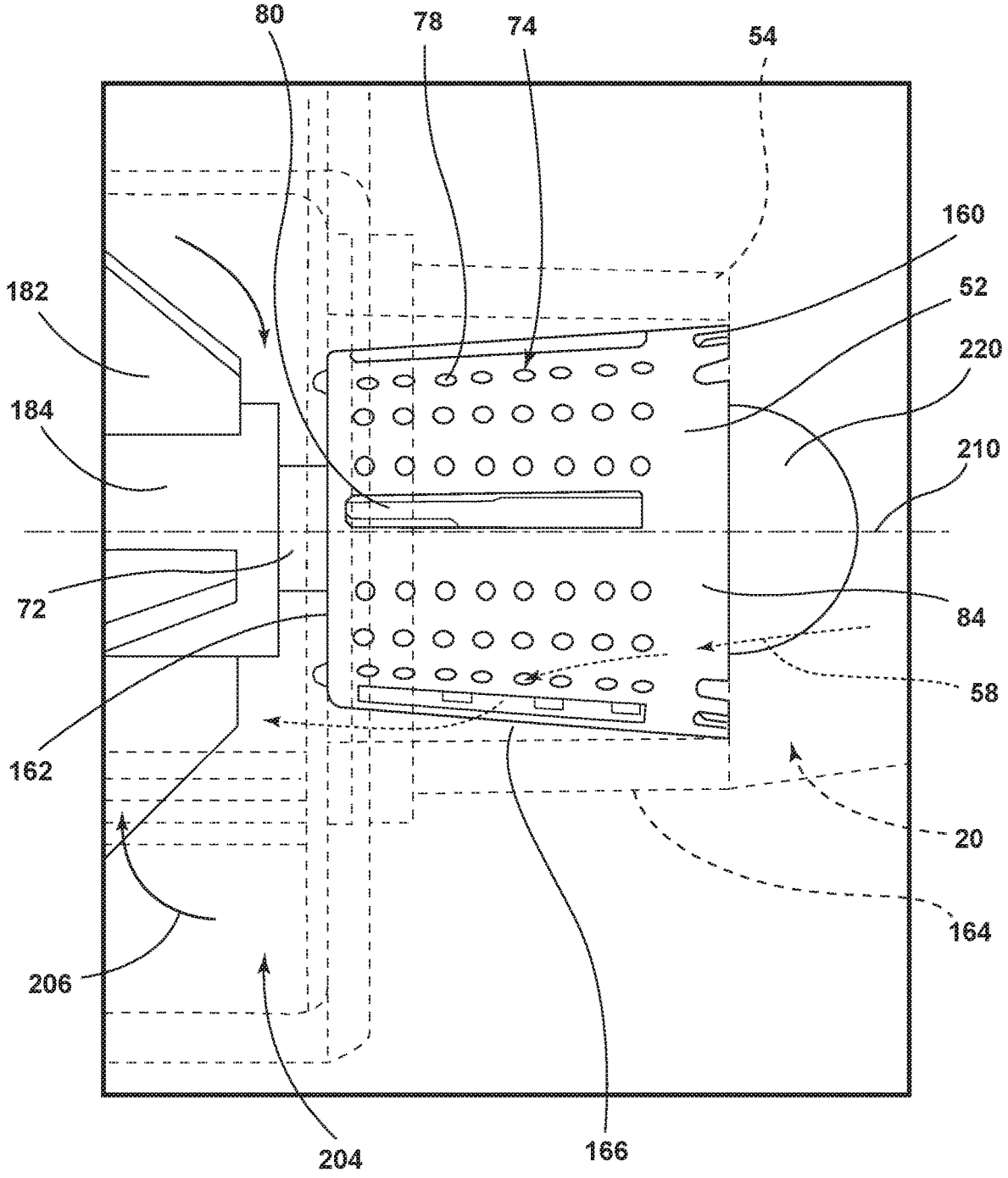
FIG. 6 is an enlarged elevational view of the lint processing pump of FIG. 5.
Figure 7:
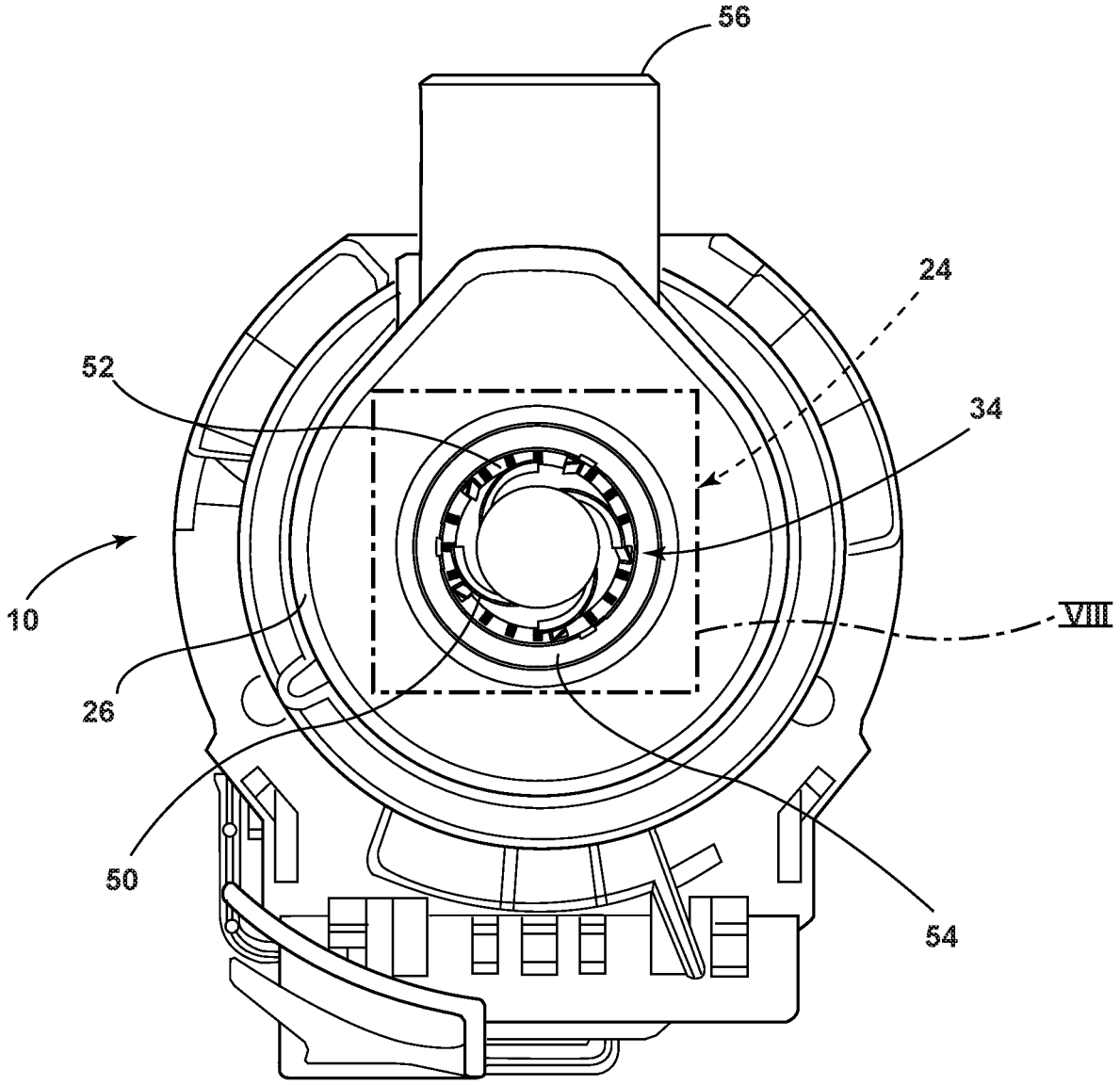
FIG. 7 is a front elevational view of the lint processing pump of FIG. 5.
Figure 8:
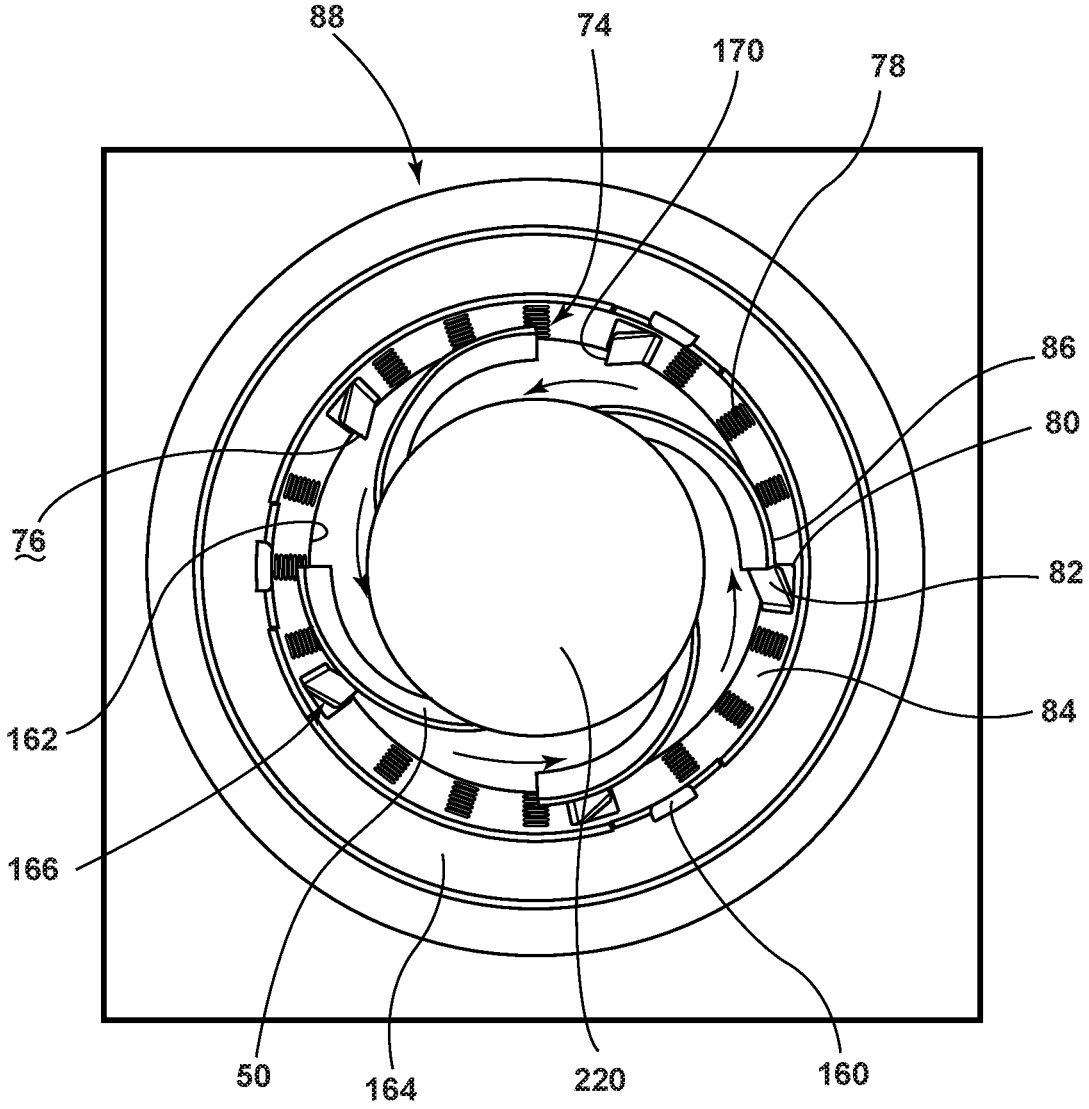
FIG. 8 is an enlarged elevational view of the lint processing pump of FIG. 7 taken at area VIII.
Figure 9:
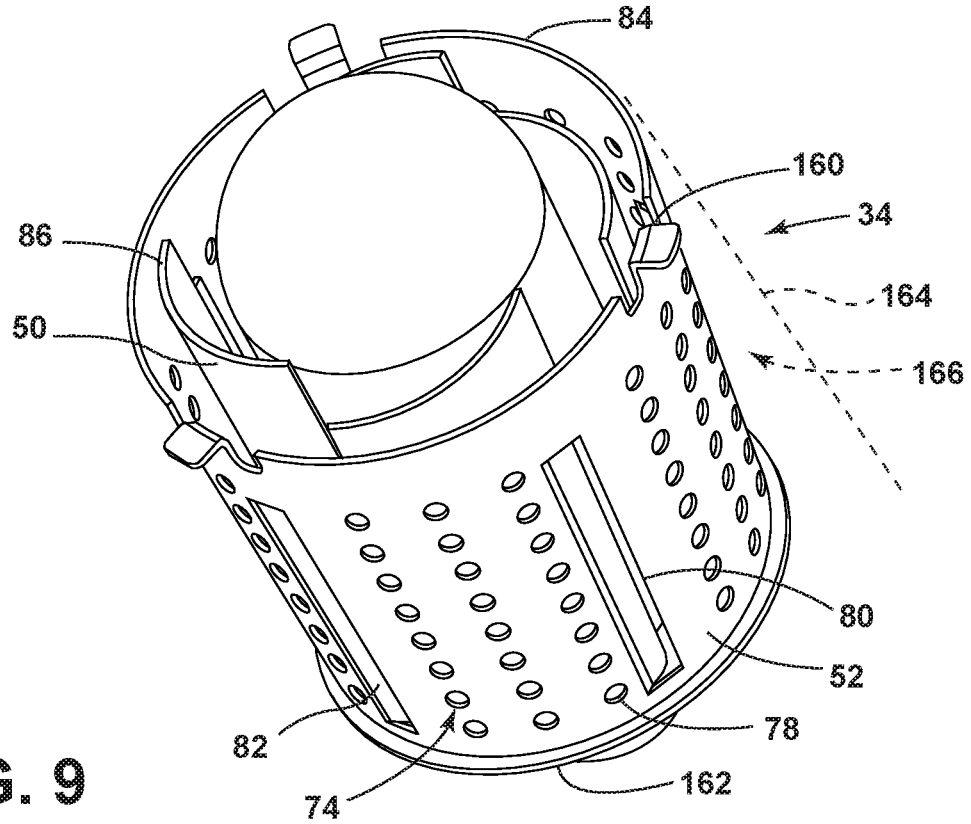
FIG. 9 is a perspective view of an aspect of a blade assembly for a lint processing pump.
Figure 10:
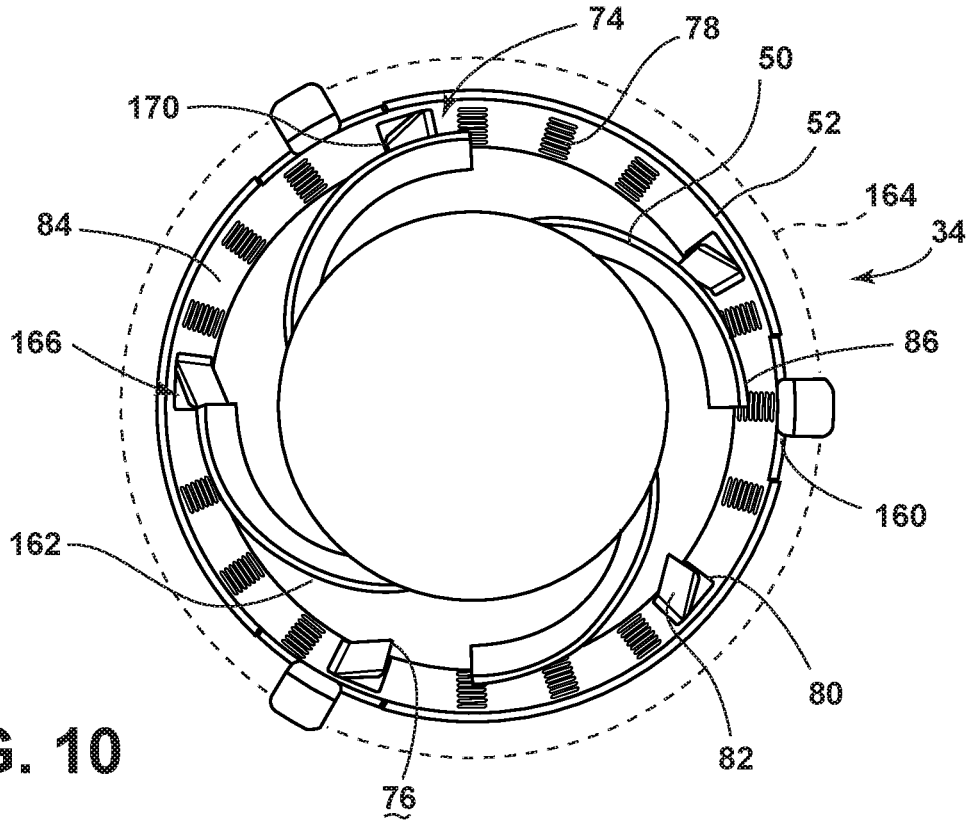
FIG. 10 is a front elevational view of the lint processing pump of FIG. 9.
Figure 11:
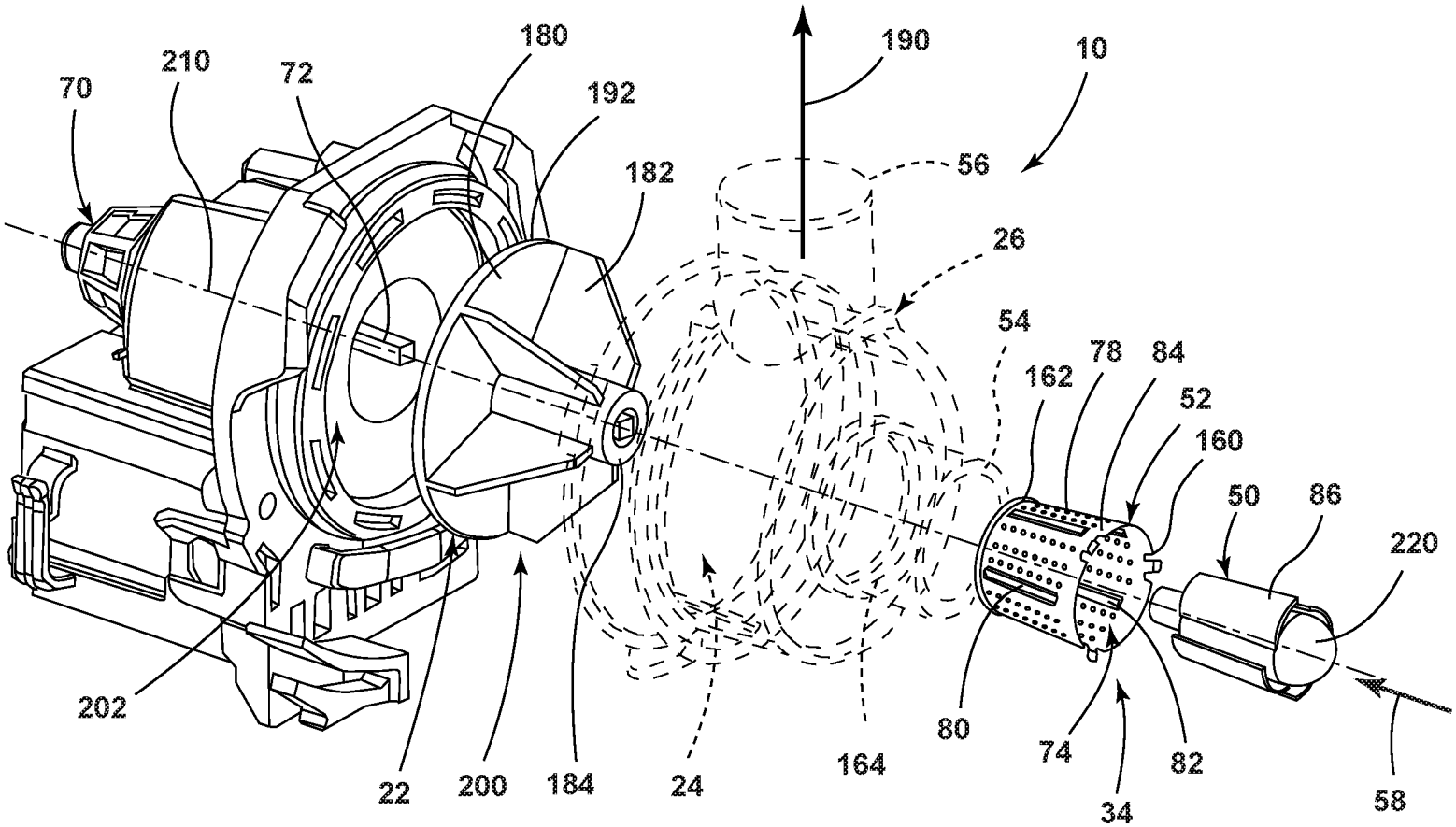
FIG. 11 is an exploded perspective view of the lint processing pump of FIG. 5.
Figure 12:
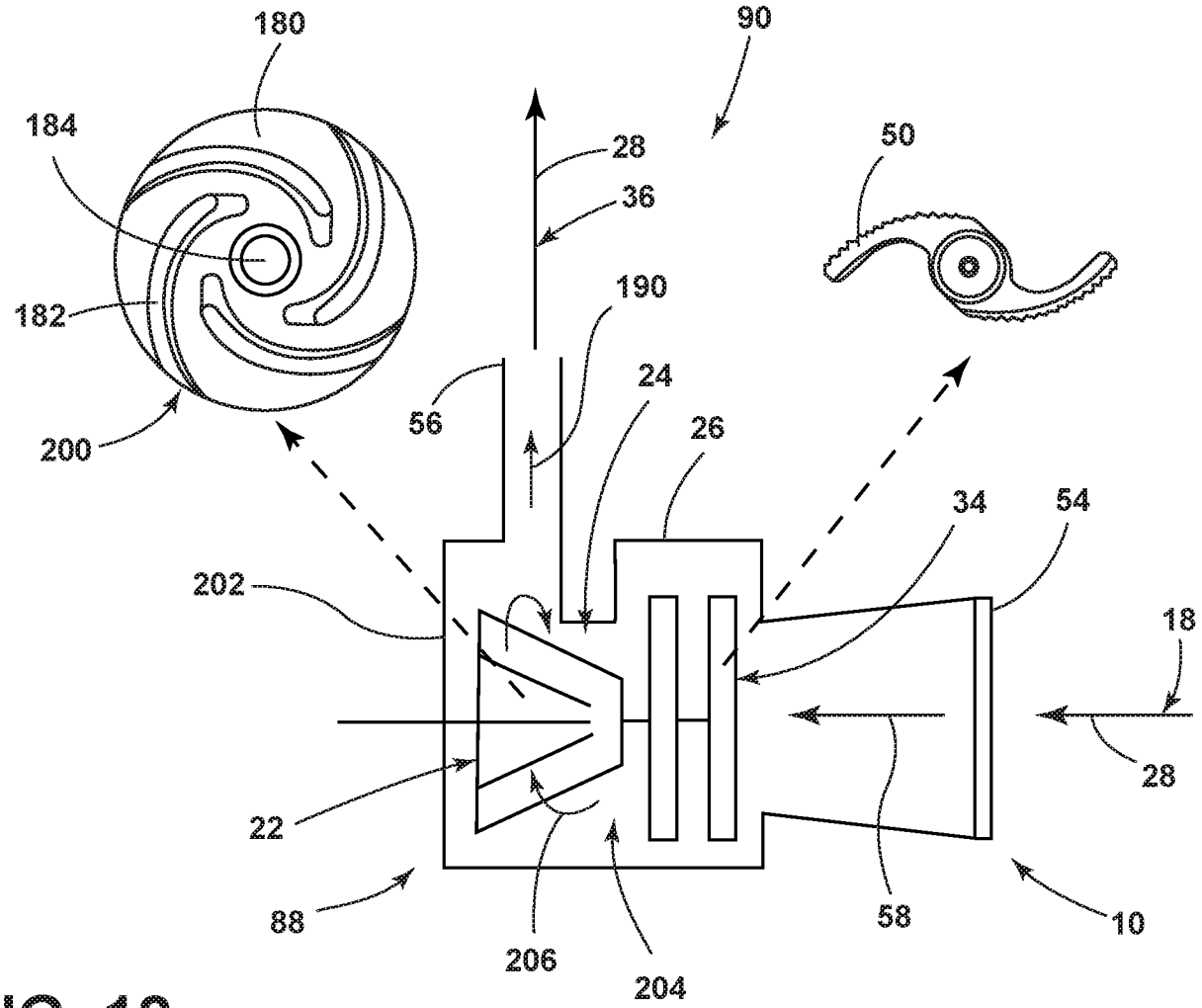
FIG. 12 is a schematic diagram illustrating aspects of an aspect of a lint processing pump for a laundry appliance.
Figure 14:
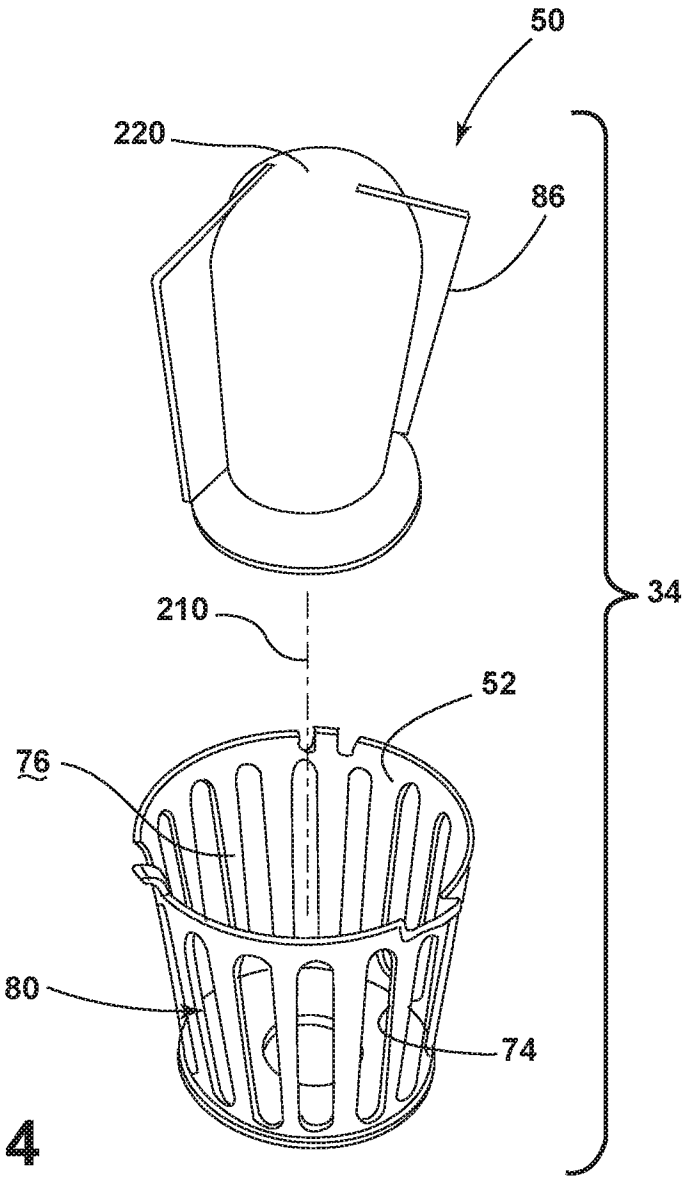
FIG. 14 is an exploded perspective view of the blade assembly of FIG. 13.
Figure 13:
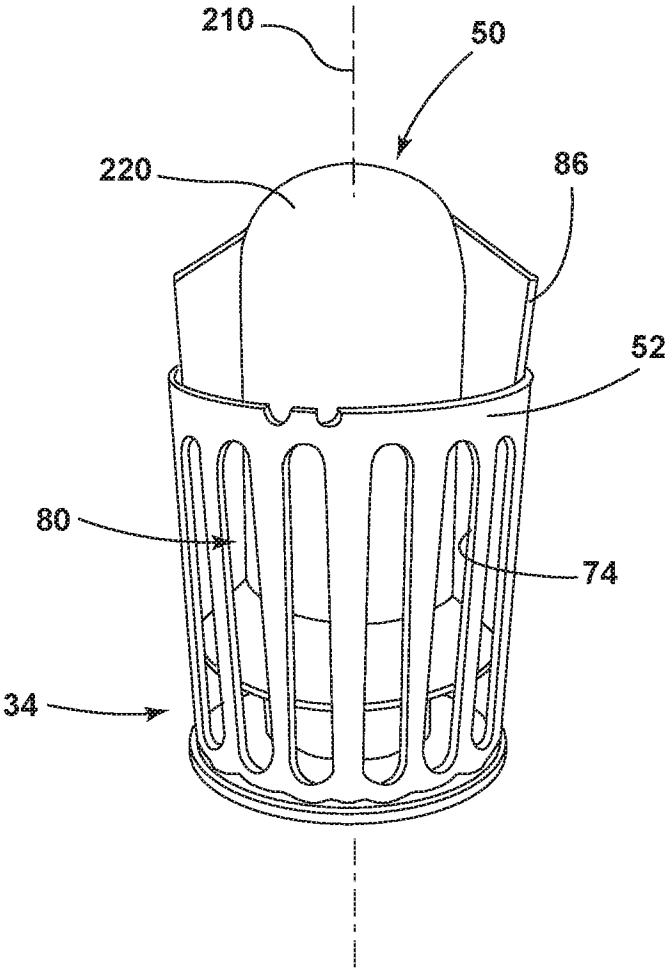
FIG. 13 is a perspective view of an aspect of the blade assembly for a lint processing pump.
Figure 15:
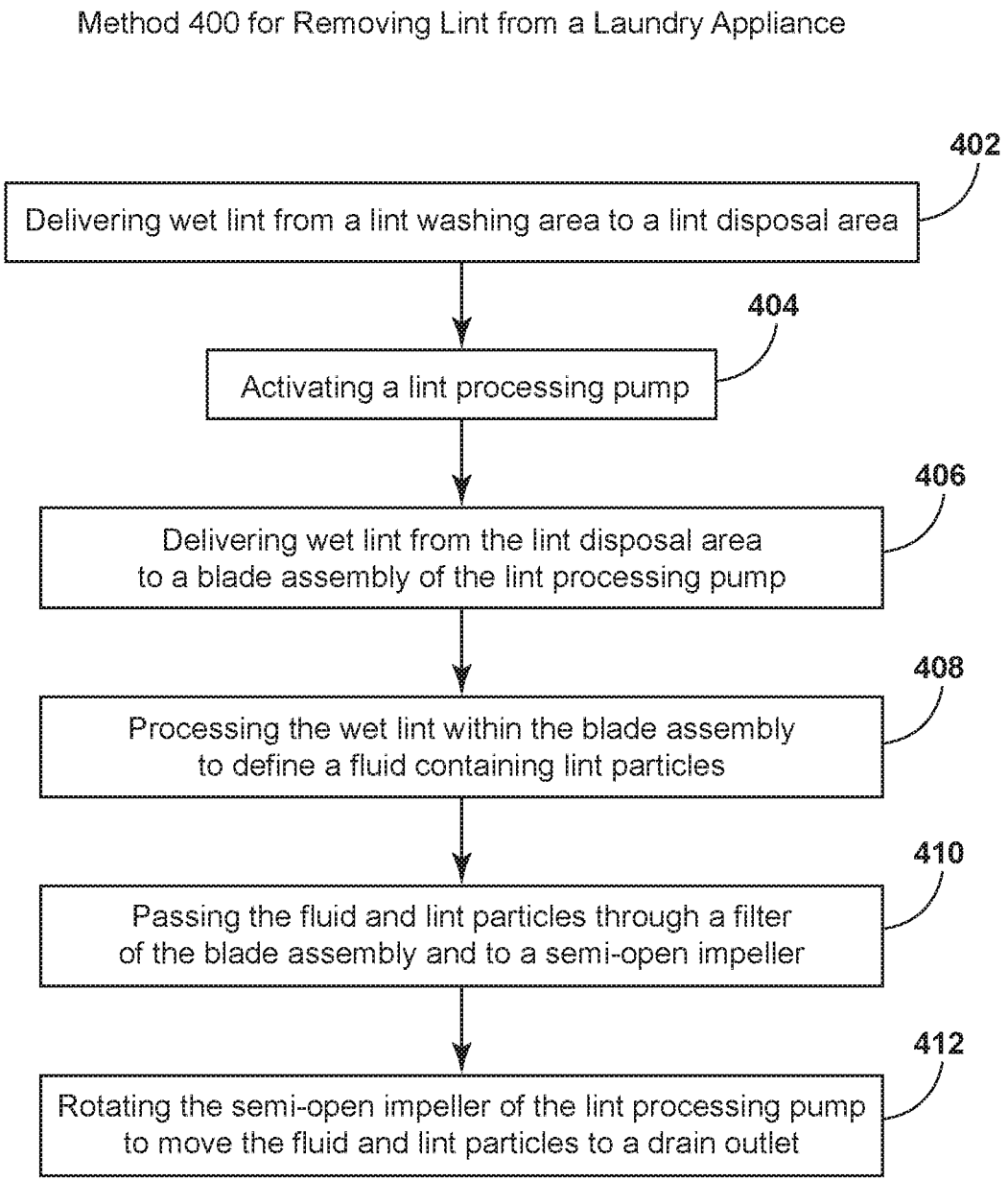
FIG. 15 is a schematic flow diagram illustrating a method for removing lint from a laundry appliance, using a lint processing pump.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As illustrated in FIGS. 1-11, reference numeral 10 generally refers to a lint processing pump 10 for use in connection with a lint removal system 12 for a laundry appliance 14. According to the various embodiments, the lint removal system 12 for the laundry appliance 14 can include a lint washing assembly 16 that is adapted to deliver wet lint 18 to a disposal area 20. The disposal area 20 is adapted to temporarily retain the wet lint 18 for processing within the lint processing pump 10. The lint processing pump 10 can include an impeller 22, typically a semi-open impeller 22, or an at least partially open and/or at least partially enclosed impeller 22, disposed within a continuous processing chamber 24 of a pump casing 26. The impeller 22 is operable to deliver a fluid 28, including the wet lint 18, from the disposal area 20 to a drain outlet 30. According to the various embodiments, the fluid 28 can include water extracted from laundry, wash water, liquid 32 from the lint washing assembly 16, various detergents and other laundry-related substances, particulate matter, the wet lint 18 contained in the disposal area 20 and other similar laundry-related materials. A blade assembly 34 is disposed within the continuous processing chamber 24. The blade assembly 34 is rotationally operable to process the wet lint 18 from the disposal area 20 to define lint particles 36 that are delivered as part of the fluid 28 to the drain outlet 30. According to the various embodiments, operation of the impeller 22 at least partially draws the fluid 28 from the blade assembly 34, past the impeller 22 and through a drain pipe 140 to the drain outlet 30.

Referring again to FIGS. 1-11, it is contemplated that the blade assembly 34 can include a rotating blade 50 that slidably engages a filter 52 to process the wet lint 18 into the lint particles 36 that can be disposed within the fluid 28. According to the various embodiments, the blade assembly 34 can be coupled to the pump casing 26 at a fluid and lint inlet 54 that is in communication with the disposal area 20. In this manner, the pump casing 26 can include the fluid/lint inlet 54 that is positioned proximate the blade assembly 34 and a pump outlet 56 that is positioned proximate the impeller 22. Accordingly, operation of the impeller 22 directs the movement of fluid 28, including the wet lint 18 from the disposal area 20 and into the blade assembly 34. It is also contemplated that operation of the blade assembly 34 can provide additional suction-type force 58 that draws the fluid 28 and wet lint 18 into the processing chamber 24 for processing the wet lint 18. The suction-type force 58 also draws the fluid 28 containing the lint particles 36 from the blade assembly 34 toward the impeller 22 and the pump outlet 56.

Referring again to FIGS. 5 and 11, the lint processing pump 10 can include a motor 70 that is attached to the pump casing 26. A drive shaft 72 is adapted to be in communication with the motor 70, the impeller 22 and the blade assembly 34. In this manner, operation of the motor 70 rotates the drive shaft 72 and, in turn, rotates the impeller 22 and a portion of the blade assembly 34 within the processing chamber 24. This operation of the impeller 22 and the blade assembly 34 serves to process the wet lint 18 and also place the disposal area 20 in communication with the drain outlet 30. Accordingly, operation of the motor 70 moves the fluid 28 and wet lint 18 and processes the wet lint 18 into lint particles 36 that are delivered to the drain outlet 30. Typically, the drive shaft 72 will be coupled to the rotating blade 50, such that the rotating blade 50 rotates within the filter 52 positioned at least partially around the rotating blade 50.

According to various embodiments, it is contemplated that the filter 52 can rotate around a substantially fixed cutting member such that the filter 52 rotates and slidably engages portions of the cutting member to process the wet lint 18 into the lint particles 36 that are moved to the drain outlet 30.

Referring again to FIGS. 5-10, it is contemplated that the filter 52 can be a generally conical member having a plurality of apertures 74. In such an embodiment, the rotating blade 50 slidably engages the filter 52 proximate a portion of the apertures 74. In this manner, the portion of the apertures 74 that slidably engage the blade 50 define a cutting surface 76 of the filter 52. The cutting surface 76 of the filter 52 is slidably engaged with the rotating blade 50 to chop, sever, cut, disintegrate, or otherwise process portions of the wet lint 18 into the lint particles 36 that are moved with the fluid 28 to the drain outlet 30.

Referring again to FIGS. 5-10, 13 and 14, the plurality of apertures 74 of the filter 52 can include fluid apertures 78 and/or processing apertures 80. It is contemplated that the processing apertures 80 at least partially define the cutting surface 76. These processing apertures 80 can be defined by a flap 82 of the filter wall 84 bent inward to simultaneously define the processing aperture 80 and also define the cutting surface 76 that extends inward toward the rotating blade 50. The processing apertures 80 can also include elongated slots that are defined within the surface of the filter 52. In such an embodiment, the elongated slots can be free of the inward extending flap 82 and the edges of the elongated slots can define the cutting surfaces 76. The blades 50 can slidably rotate against the filter 52 and across each of the processing apertures 80.

Referring again to FIGS. 5-10, 13 and 14, the blades 50 can be shaped to generally direct the fluid 28 and the wet lint 18 in an outward direction and toward the cutting surfaces 76. In this manner, the blades 50 can have a sloped configuration and can have a linear or generally arcuate shape. In the various embodiments, rotation of the blade 50 provides a centrifugal force upon the fluid 28 and the wet lint 18. As the blade 50 rotates, outer portions 86 of the rotating blade 50 slidably engage the cutting surface 76 or cutting surfaces 76 that define a lint processing state 88 that processes the wet lint 18 into lint particles 36. These lint particles 36 are processed to be small enough to be passed through the processing apertures 80, and possibly the fluid apertures 78, of the filter 52. Where present, the fluid apertures 78 are adapted to allow smaller particulate matter and liquid components of the fluid 28 to pass therethrough past the impeller 22 and into the pump outlet 56. Again, it is contemplated that the filter 52 may define only the processing apertures 80 and may not contain any of the fluid apertures 78.

Referring again to FIGS. 1 and 2, it is contemplated that the lint removal system 12 can include the lint washing assembly 16 that can include a liquid sprayer 100 that captures dry lint 98, wets the dry lint 98 to define wet lint 18, and delivers the wet lint 18 to the disposal area 20. The liquid sprayer 100 of the washing assembly can be adapted to spray a liquid 32, such as water, onto an air filter 52, onto or through a heat exchanger, or other similar surface that is adapted to capture dry lint 98 as process air 102 moves through the laundry appliance 14. It is also contemplated that the liquid sprayer 100 can be used to pass the liquid 32 through process air 102 that contains dry lint 98. In such an embodiment, the liquid 32 is sprayed through the lint-containing process air 102 to capture the dry lint 98, wet the dry lint 98 to define wet lint 18, and transfer the wet lint 18 to the disposal area 20. As such, the lint removal system 12 described herein can be incorporated within laundry appliances 14 having filters 52 and also filter-free laundry appliances 14. It is further contemplated that the lint removal system 12 can be disposed within laundry appliances 14 that can include dryers, washers, and combination washers and dryers.

Referring again to FIGS. 1-3, typically, the lint removal system 12 described herein will be incorporated within a laundry appliance 14 having a heat pump system 110. Such a heat pump system 110 is adapted to incorporate a thermal transfer mechanism such as a refrigerant loop that transfers heat between various heat exchangers disposed within the appliance 14. According to the various embodiments, the heat exchangers of the heat pump system 110, during operation, may accumulate lint, fluff and other particulate matter that adheres to the surface of the heat exchanger. Filters 52 can be incorporated to remove lint and minimize the amount of dry lint 98, and possibly wet lint 18, that is captured on the surface of the heat exchanger. This dry lint 98 that is captured within filter assemblies and on the surface of the heat exchangers can be sprayed by the lint washing assembly 16 to remove and wet the dry lint 98 adhered to a surface or contained within process air 102 and move the wet lint 18 to the disposal area 20.

Referring again to FIGS. 2-4, the laundry appliance 14 can include an airflow path 120 that moves process air 102 from a drum 122 of the appliance 14 through the heat pump system 110. Before the process air 102 reaches the heat pump system 110, the process air 102 can be moved through the lint removal system 12. In certain embodiments, the lint removal system 12 can include the liquid sprayer 100 only, such as in a filterless laundry appliance 14. The lint removal system 12 can also include a separate screen-type filter where the liquid sprayer 100 removes dry lint 98 from the screen-type filter. The liquid sprayer 100 can also be used to remove dry lint 98 from the surface of a heat exchanger that is positioned within the airflow path 120. In each of these embodiments, the lint washing assembly 16 is adapted to remove dry lint 98 from a surface or from the process air 102 and deliver wet lint 18 to the disposal area 20 for processing within the lint processing pump 10.

Referring again to FIGS. 2 and 3, it is contemplated that the disposal area 20 can be in the form of a drain channel 130 that is generally sloped toward the fluid/lint inlet 54 of the lint processing pump 10. It is also contemplated that various channel sprayers can be disposed proximate the disposal area 20 for spraying liquid 32 through the wet lint 18 to push the wet lint 18 into the fluid/lint inlet 54 to assist in processing wet lint 18 into lint particles 36. Alternatively, the drain channel 130 can use the force of gravity to direct a flow of the fluid 28 that directs the wet lint 18 towards the fluid/lint inlet 54 for processing.

Referring again to FIGS. 2-4, after the wet lint 18 is processed into lint particles 36 and the fluid 28 is moved through the lint processing pump 10 and towards the drain outlet 30, a drain pipe 140 can extend from the pump outlet 56 to the drain outlet 30 for delivery of the fluid 28 having the lint particles 36. The drain pipe 140 can include one or more check valves 142 that allow for the flow of fluid 28 in one direction and substantially prevent backflow of the fluid 28 back toward the lint processing pump 10.

Referring again to FIGS. 1-4, where the laundry appliance 14 includes separate liquid handling functions, such liquid 32 can be delivered from the drum 122 of the appliance 14 through a separate sump 150 and drain and to the drain outlet 30. This separate sump 150 and drain can be included within drying appliances 14 where water extracted from the wet laundry within the drum 122 is moved to the sump 150 and liquid 32 from the lint washing assembly 16 for moving the wet lint 18 is directed separately to the disposal area 20 within the drain channel 130. Accordingly, the separate materials can be processed separately and delivered out of the appliance 14 to a drain outlet 30. Additionally, the fluid 28 having the lint particles 36 can be combined with the liquid 32 from the sump 150 for simultaneous disposal through the drain outlet 30.

According to the various embodiments, the drain outlet 30 can be delivered to an external drain outside of the appliance 14. It is also contemplated that the drain outlet 30 can be used to deliver the fluid 28 having the lint particles 36 to a separate container that can be removed from the appliance 14 manually and emptied in the separate drain outside of the appliance 14.

Referring now to FIGS. 5-11, the lint processing pump 10 that is incorporated within the lint removal system 12 can include the pump casing 26 having an interior cavity in the form of the continuous processing chamber 24. The impeller 22 is disposed within the continuous interior cavity. The blade assembly 34 is also disposed within the continuous interior cavity, adjacent the impeller 22. The blade assembly 34 includes the rotationally operable blade 50 and a filter 52 that is engaged with the blade 50. Operation of the blade 50 serves to define the lint processing state 88 of the blade assembly 34. In the lint processing state 88, the blade 50 slidably engages a cutting surface 76 of the filter 52 and places the blade 50 in fluid communication with the impeller 22 through the filter 52. In this manner, the interior cavity includes a single continuous cavity, or processing chamber 24, that houses the impeller 22 and the blade assembly 34. Other cavities can be included to have the motor 70 and other aspects of the lint processing pump 10. To operate the impeller 22 and the blade 50, the motor 70 is attached to the drive shaft 72 that is rotationally operated by the motor 70. It is contemplated that each of the impeller 22 and the blade 50 are attached to the drive shaft 72 and are simultaneously operated through operation of the motor 70.

Referring again to FIGS. 5-11, it is contemplated that the interior cavity defines the continuous processing chamber 24, where both of the impeller 22 and blade assembly 34 are disposed within the single continuous processing chamber 24. In this manner, the casing is free or substantially free of dividing walls that extend between and separate the blade assembly 34 from the impeller 22. Accordingly, fluid 28 and wet lint 18 that is moved into the blade assembly 34 and processed to define the fluid 28 having the lint particles 36 is moved directly from the blade assembly 34 to the impeller 22 for convenient disposal from the impeller 22 to the pump outlet 56.

Referring again to FIGS. 5-11, 13 and 14, the filter 52 of the blade assembly 34 can be a generally conical screen that includes the plurality of apertures 74 defined therein. The generally conical shape of the filter 52 allows for a filter attachment end 160 that directly engages and attaches to the fluid/lint inlet 54. The opposing end 162 of the filter 52, having a smaller diameter, sits inward from an inlet wall 164 of the pump casing 26 to define a fluid flow area 166 between the filter 52 and the pump casing 26. In this manner, as the wet lint 18 is processed into the lint particles 36, the fluid 28 containing the lint particles 36 flows through the apertures 74 of the filter 52, through the fluid flow area 166 and toward the impeller 22. The fluid 28 containing the lint particles 36, which can define a slurry-type mixture, can then be directed through the pump outlet 56.

Referring again to FIGS. 5-11, 13 and 14, the cutting surface 76 of the filter 52 can be defined by an edge 170 of at least one of the apertures 74, such as the processing apertures 80. As discussed above, the processing aperture 80 can include an inwardly extending flap 82 that extends toward the rotating blade 50 and engages or substantially engages a portion of the rotating blade 50. During rotation of the blade 50, the engagement of the blade 50 with the cutting surface 76 serves to substantially disintegrate the wet lint 18 into the lint particles 36 that are allowed to pass through the processing apertures 80 of the filter 52 of the blade assembly 34 and into the fluid flow area 166 around the filter 52. The blade 50 can continually operate in the lint processing state 88 until all or substantially all of the wet lint 18 has been processed into the lint particles 36 and moved through the fluid flow area 166.

Referring again to FIGS. 5-11, 13 and 14, in order to position the blade assembly 34 relative to the impeller 22, the blade assembly 34 can be coupled to a pump casing 26 proximate the fluid/lint inlet 54 as the filter attachment end 160 of the filter 52. The generally conical configuration of the filter 52 can be seated within the fluid/lint inlet 54 such that the blade assembly 34 can be placed in a generally fixed position and allow for rotational operation of the blade 50 of the blade assembly 34. Additionally, the space between the filter 52 and the inlet wall 164 of the pump casing 26 defines the fluid flow area 166. In this manner, the blade assembly 34 can be positioned within the processing chamber 24 along with the impeller 22 and also provide for the movement of fluid 28 and lint particles 36. Accordingly, the impeller 22 and the blade assembly 34 are each disposed within a continuous processing chamber 24 of the blade assembly 34. It is contemplated that various aspects of the blade 50 can include serrations, sharpened edges, spines and other cutting mechanisms that may assist in the processing of the wet lint 18.

Referring again to FIGS. 5-12, the impeller 22 of the lint processing pump 10 can include a semi-open impeller 22 having a shroud or base plate 180 that engages the plurality of paddles 182 of the impeller 22. The paddles 182 can extend outward from a central hub 184 and are attached to the base plate 180. It is contemplated that the paddles 182 of the impeller 22 can include planar members that extend outward from the central hub 184 or can be substantially arcuate members that curve outward from the central hub 184 and along the base plate 180. It is also contemplated that the paddles 182 can either directly engage the central hub 184 or can be set apart from the central hub 184. The exact configuration of the paddles 182 relative to the central hub 184 and the base plate 180 can affect the particle size of the lint particles 36 that are allowed to be delivered or passed by the semi-open impeller 22 and to the pump outlet 56. The use of the semi-open impeller 22 is incorporated to allow the lint particles 36 to be received by the impeller 22 from the blade assembly 34. The semi-open impeller 22 includes a single discharge path 190 proximate an outer edge 192 of the impeller 22. Additionally, the inclusion of a single base plate 180 and an open opposing end 162 allows for the paddles 182 to directly receive the fluid 28 having the lint particles 36 and allows the lint particles 36 to pass through the semi-open impeller 22.

Referring again to FIGS. 5-12, it is contemplated that the impeller 22 can be a type of semi-open impeller 22 commonly referred to as a vortex impeller 200. The vortex impeller 200 is typically mounted toward the rear 202 of the pump casing 26 and allowing for a gap 204 upstream of the rotating paddles 182. This gap 204 is typically the size of or approximately the size of the pump outlet 56. The spinning of the vortex-type impeller 22 creates a force vortex 206 in front of the vortex impeller 200 such that the suction-type force 58 is generated by a low pressure core that forms at the fluid/lint inlet 54 and within the blade assembly 34. The speed and pressure of the fluid 28 moving through the lint processing pump 10 can increase as the fluid 28 moves outward in relation to the vortex impeller 200 until the fluid 28 having the lint particles 36 is thrown, or otherwise discharged outward through the pump outlet 56. As with conventional semi-open impellers 22, the vortex impeller 200 also allows the lint particles 36 to pass through the lint processing pump 10 without having to necessarily physically engage the surface of the impeller 22. The vortex 206 created by the vortex impeller 200 allows for the movement of lint particles 36 in front of the vortex impeller 200 and out of the pump outlet 56 without being constrained between the paddles 182 of the semi-open impeller 22.

Additionally, the use of the semi-open impeller 22 and/or the vortex impeller 200 serves to limit binding or clogging of the lint processing pump 10 during the processing of the wet lint 18 into the lint particles 36.

While the semi-open impeller 22 is disclosed herein, it is also contemplated that the lint processing pump 10 can include an open impeller or a closed impeller. Where the open and closed impellers are used, the lint particles 36 are typically processed into a more fine particle size and/or where a greater amount of liquid 32 is mixed with the lint particles 36 to form a less viscous fluid 28, or slurry, that is passed through the open or closed impeller.

Referring again to FIGS. 5-12, according to the various embodiments, the paddles 182 of the impeller 22 can either be vortex-shaped or can be shaped in a generally conical configuration to generate the vortex 206 upstream of the impeller 22 that allows the fluid 28 to pass from the blade assembly 34, through the vortex 206 created by the impeller 22, and out the pump outlet 56. Typically, the pump outlet 56 will be positioned at an angle generally perpendicular to the axis of rotation 210 defined by the drive shaft 72 coupled to the motor 70. In this manner, the vortex 206 generated by the impeller 22 can use centrifugal force to push the fluid 28 containing the lint particles 36 away from the impeller 22 and towards the perpendicularly disposed drain outlet 30 to force the fluid 28 through the drain line and into the drain outlet 30.

Referring again to FIGS. 6-10, it is contemplated that as the fluid 28 containing the wet lint 18 from the disposal area 20 enters the blade assembly 34, the wet lint 18 and liquid 32 forming the fluid 28 is mixed and disintegrated into a slurry having a regulated size of lint particles 36. These lint particles 36 of the fluid 28 are moved through the processing apertures 80 of the filter 52 and are pulled by the impeller 22 into the vortex 206 generated by the impeller 22. It is contemplated that during operation of the blade assembly 34, the blade 50 rotates within the filter 52 and moves the wet lint 18 outward and toward the cutting surface 76. As the blades 50 engage the cutting surface 76, the wet lint 18 is disintegrated into the lint particles 36 and passed through the processing apertures 80 of the filter 52. In this manner, the slurry that is formed by the fluid 28 containing the lint particles 36 flows normal or perpendicular to the axis of rotation 210 defined by the drive shaft 72 and enters the vortex 206 defined by the rotation of the impeller 22.

Referring again to FIGS. 7-10, 13 and 14, it is contemplated that the rotating blade 50 of the blade assembly 34 can be defined by a plurality of arcuate blades 50 that extend outward from a blade hub 220. As the blade hub 220 rotates, the arcuate blades 50 slidably engage the cutting surface 76 of the filter 52. The wet lint 18 is processed through the engagement of the blades 50 against the cutting surface 76 of the filter 52 to be disintegrated into the lint particles 36. The lint particles 36 are then moved through the processing apertures 80 and into the vortex 206 defined by the impeller 22. It is contemplated that the vortex 206 can extend into the fluid flow area 166 between the filter 52 and the inlet wall 164 of the pump casing 26. It is also contemplated that the lint particles 36 can be small enough to pass through the fluid apertures 78 and then moved into the vortex 206 defined by the impeller 22.

Referring again to FIGS. 1-12, it is contemplated that the lint processing pump 10 can include a pump casing 26 having a continuous interior cavity that forms the processing chamber 24. The impeller 22 is disposed within the continuous interior cavity proximate the pump outlet 56. The blade assembly 34 is disposed within a continuous interior cavity proximate the fluid/lint inlet 54. It is contemplated that operation of the blade assembly 34 defines a lint processing state 88 that places the fluid/lint inlet 54 in communication with the pump outlet 56 via the continuous interior cavity. As discussed above, the blade assembly 34 includes the plurality of blades 50 that slidably engage the filter 52 having a plurality of apertures 74. A portion of the apertures 74 define the cutting surface 76 of the filter 52. The cutting surface 76 being slidably engaged by the rotating blade 50 serves to define the lint processing state 88 of the blade assembly 34 that disintegrates or otherwise processes the wet lint 18 into lint particles 36.

Referring now to FIGS. 1-15, having described the various embodiments of the lint removal system 12 and the lint processing pump 10, a method 400 is disclosed for removing lint from a laundry appliance 14. According to the method 400, wet lint 18 is delivered from a lint washing area to a lint disposal area 20 (step 402). As discussed above, the lint disposal area 20 is typically disposed proximate the fluid/lint inlet 54 of the lint processing pump 10. The lint processing pump 10 can then be activated (step 404). The lint processing pump 10 includes the blade assembly 34 and the semi-open impeller 22 that are each disposed within the single continuous processing chamber 24 of the lint processing pump 10. The wet lint 18 is then delivered from the lint disposal area 20 to the blade assembly 34 via the fluid/lint inlet 54 (step 406). Typically, operation of the impeller 22 forms the vortex 206 proximate the impeller 22 that defines a low pressure area and the suction-type force 58 proximate the blade assembly 34. This suction-type force 58 serves to draw fluid 28 including the wet lint 18 into the blade assembly 34. The wet lint 18 is then processed within the blade assembly 34 to define the lint particles 36 (step 408). After the lint particles 36 are processed, the lint particles 36 are passed through the filter 52 and are delivered to the semi-open impeller 22 (step 410). The impeller 22 is rotated to move the lint particles 36 along with the remainder of fluid 28 to the drain outlet 30 (step 412).

As discussed above, rotation of the impeller 22 typically generates a vortex 206 in front of the impeller 22. This vortex 206 serves to capture the fluid 28 containing the lint particles 36 and moves the fluid 28 to the drain outlet 30 without causing substantial engagement between the lint particles 36 and the surface of the impeller 22 itself. The vortex 206 is typically formed in front of or upstream the impeller 22, such that the lint particles 36 can be moved to the drain outlet 30 without direct engagement or substantially direct engagement between the lint particles 36 and the impeller 22. In this manner, clogging and other obstructions can be generally avoided through the use of the semi-open impeller 22 for the lint processing pump 10.

According to the various embodiments, it is contemplated that the lint processing pump 10 can be disposed within any one of several appliances 14 that include a lint processing function or other similar function for processing particulate matter. Such appliances 14 can include, but are not limited to, laundry appliances 14, dishwashers, disposals, and other similar appliances 14 that include a processing function for converting a material into smaller particles to be disposed.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A lint removal system for a laundry appliance, the lint removal system comprising:

a lint disposal assembly adapted to deliver wet lint to a lint disposal area;

an at least partially open impeller disposed within a single processing chamber of a pump casing, the at least partially open impeller operable to deliver a fluid from the lint disposal area to a drain outlet; and a blade assembly disposed within a cylindrical wall of the single processing chamber, the blade assembly having a rotating blade that is rotationally operable about a rotational axis to process the wet lint from the lint disposal area to define lint particles that are delivered with the fluid to the drain outlet, wherein the blade assembly includes the rotating blade having an outer edge that is generally angled with respect to the rotational axis and slidably engages a filter to process the wet lint, the rotating blade rotating within the filter, wherein the filter includes a generally conical shape that defines a fluid flow area between the filter and the cylindrical wall of the single processing chamber, wherein the generally conical shape of the filter narrows in a direction of the at least partially open impeller to define the fluid flow area as having a cross-sectional area between the generally conical shape of the filter and the cylindrical wall that increases in the direction of the at least partially open impeller to promote a flow of fluid and lint particles in a horizontal direction toward the at least partially open impeller.

2. The lint removal system of claim 1, wherein the filter includes a plurality of apertures and the blade assembly slidably engages an inside surface of the filter proximate at least a portion of the apertures.

3. The lint removal system of claim 2, wherein a portion of the apertures define a cutting surface of the filter, the cutting surface being slidably engaged by the rotating blade.

4. The lint removal system of claim 1, further comprising:

a motor attached to the pump casing; and a drive shaft in communication with the motor, the at least partially open impeller and the blade assembly, wherein operation of the motor rotates the at least partially open impeller and a portion of the blade assembly within the single processing chamber to process the wet lint into the lint particles and move the lint particles to the drain outlet.

5. The lint removal system of claim 3, wherein the plurality of apertures includes fluid apertures and processing apertures, wherein the processing apertures at least partially define the cutting surface.

6. The lint removal system of claim 1, wherein the blade assembly is coupled to the pump casing at a fluid and lint inlet in communication with the lint disposal area.

7. The lint removal system of claim 1, wherein the pump casing includes a fluid and lint inlet positioned proximate the blade assembly and a pump outlet positioned proximate the at least partially open impeller.

8. A lint processing pump comprising:

a pump casing having an interior cavity;

an impeller disposed within the interior cavity; and a blade assembly disposed within a cylindrical wall of the pump casing, upstream of the impeller, the blade assembly including a rotationally operable blade and a filter engaged with the blade, wherein the blade and the filter are a generally conical shape and the blade concentrically rotates within an inside surface of the filter, wherein a fluid flow area is defined between the generally conical shape of the filter and the cylindrical wall of the pump casing; wherein the generally conical shape of the filter narrows in a direction of the impeller to define the fluid flow area between the cylindrical wall and the filter as an expanding area that enlarges in the direction of the impeller; and operation of the blade defines a lint processing state of the blade assembly wherein the blade slidably engages a cutting surface of the filter and produces a suction-type force to move wet lint from the blade assembly, through the expanding area of the fluid flow area and toward the impeller.

9. The lint processing pump of claim 8, further comprising:

a motor and a drive shaft rotationally operated by the motor, wherein each of the impeller and the blade are attached to the drive shaft.

10. The lint processing pump of claim 8, wherein the filter is a generally conical screen having a plurality of apertures defined therein.

11. The lint processing pump of claim 10, wherein the cutting surface of the filter is defined by an edge of at least one of the apertures.

12. The lint processing pump of claim 10, wherein the plurality of apertures includes fluid apertures and processing apertures, wherein the processing apertures at least partially define the cutting surface.

13. The lint processing pump of claim 8, wherein the blade assembly is coupled to the pump casing at a fluid and lint inlet.

14. The lint processing pump of claim 8, wherein the pump casing includes a fluid and lint inlet positioned proximate the blade assembly and a pump outlet positioned proximate the impeller.

15. The lint processing pump of claim 8, wherein the interior cavity includes a single processing cavity that houses the impeller and the blade assembly.

16. A lint processing pump comprising:

a pump casing having a single processing cavity that includes a cylindrical wall;

an impeller disposed within the single processing cavity upstream of a pump outlet; and a blade assembly disposed within the cylindrical wall of the single processing cavity downstream of a fluid and lint inlet, wherein rotational operation of the blade assembly defines a lint processing state and places the fluid and lint inlet in communication with the pump outlet via the single processing cavity, wherein the blade assembly is generally conical and includes a rotating blade that slidably engages a filter having a plurality of apertures, an inside surface of the filter extending conically along a horizontal rotational axis of the blade, wherein the generally conical filter narrows along the horizontal rotational axis and in a direction of the impeller to define an expanding space between the cylindrical wall and the filter, wherein the impeller and the blade assembly are horizontally positioned to rotate about the horizontal rotational axis and within the cylindrical wall of the single processing cavity to produce a suction-type force that defines a fluid flow space within the expanding space therebetween to promote a horizontal flow of the fluid through the fluid flow space, and wherein operation of the impeller and the blade assembly moves the fluid through the blade assembly.

17. The lint processing pump of claim 16, wherein at least a portion of the apertures define a cutting surface of the filter, the cutting surface being slidably engaged by the rotating blade to define the lint processing state of the blade assembly.

18. The lint processing pump of claim 16, further comprising:

a motor attached to the pump casing; and a drive shaft in communication with the motor, the impeller and the blade assembly, wherein operation of the motor rotates the impeller and a portion of the blade assembly within the single processing cavity.

19. The lint processing pump of claim 18, wherein the blade is a rotating blade and operation of the motor rotates the rotating blade of the blade assembly.

* * * * *